United States Patent [19]

Jenkins

[11] 4,049,176

[45] Sept. 20, 1977

[54] TAG ATTACHING APPARATUS

[75] Inventor: William A. Jenkins, Englewood, Ohio

[73] Assignee: Monarch Marking Systems, Inc., Dayton, Ohio

[21] Appl. No.: 685,245

[22] Filed: May 11, 1976

[51] Int. Cl.[2] ..... B25C 1/00

[52] U.S. Cl. ..... 227/67

[58] Field of Search ..... 227/67

[56] References Cited

U.S. PATENT DOCUMENTS

| | | | |
|---|---|---|---|
| 3,924,788 | 12/1975 | Furutu | 227/67 |
| 3,971,498 | 7/1976 | Bussard | 227/67 |

*Primary Examiner*—Granville Y. Custer, Jr.
*Attorney, Agent, or Firm*—Joseph J. Grass

[57] ABSTRACT

There is disclosed an apparatus for attaching tags to merchandise using fasteners. The fasteners are arranged in a one-piece fastener assembly. Each fastener includes a bar section and a button section joined by a filament section. The apparatus includes a body and a needle connected to the body. A fastener advancing means is used to advance one fastener at a time into dispensing relationship with the needle. The fastener advancing means includes a toothed wheel. A one-piece pawl includes a U-shaped portion having a pair of flexible resilient arms. One of the arms has a tooth cooperable with the toothed wheel and the other arm is cooperable with an annular bearing surface which is disposed adjacent the wheel. The pawl includes a pair of integrally formed flexible resilient members or arms providing abutment faces. A pair of drive faces is connected to a gear segment which is driven by a manually operable actuator. One drive face is cooperable with one abutment face to drive the pawl from a first position to a second position and the other drive face is cooperable with the other abutment face to drive the pawl from the second position to the first position to cause the toothed wheel to cause advance of the fastener assembly. As the pawl is driven from the first position to the second position, a push rod is driven to drive a bar section of a fastener through the needle.

16 Claims, 9 Drawing Figures

TAG ATTACHING APPARATUS

BACKGROUND OF THE INVENTION

1. Field of the Invention

This invention relates to the field of tag attaching apparatus.

2. Brief Description of the Prior Art

The following U.S. Pat. Nos. are made of record: E. W. Finke, U.S. Pat. No. 3,650,452 dated Mar. 21, 1972, A. R. Bone, U.S. Pat. No. 3,759,435 dated Sept. 18, 1973, and A. Furutu, U.S. Pat. No. 3,924,788 dated Dec. 9, 1975.

SUMMARY OF THE INVENTION

According to the invention there is provided a tag attaching apparatus that is relatively simple in construction. The apparatus is of the type having a body and a needle mounted by the body. The needle has a bore and an elongated side opening communicating with the bore. The apparatus can utilize a fastener assembly having a runner and fasteners connected to the runner by connectors. Each fastener includes a bar section which is connected to the connector, a button section, and a filament section joining the bar and button sections. The fastener assembly is advanced by an arrangement including a toothed member specifically a toothed wheel or ratchet wheel. A pawl is movable relative to the toothed wheel for driving the toothed wheel to advance the fastener assembly so that the bar sections of the fasteners are brought successively into alignment with the needle bore. The pawl has a pair of arms, one of which carries a tooth cooperable with the ratchet wheel and the other of which counteracts the force exerted by the tooth on the ratchet wheel. The other arm bears against an annular bearing surface which is illustrated as being secured to the ratchet wheel and another toothed wheel. The other toothed wheel is engageable with the connectors. The arms are arranged in a generally U-shaped configuration and straddle the axis of rotation of the wheels. The pawl also includes flexible resilient arms or members which extend in generally opposite directions and which terminate at respective abutment faces. An actuator drives a gear having a pair of drive faces. One drive face cooperates with one abutment face to drive the pawl from a first position to a second position and the other drive face cooperates with the other abutment face to drive the pawl from the second position to the first position to drive the toothed wheels to advance the fastener assembly. While the pawl is being driven from the first position to the second position the push rod is driven forward to push the bar section of a fastener through the bore of the needle while its filament section extends through the side opening. The pawl is preferably of one-piece molded plastics construction.

DESCRIPTION OF THE PREFERRED EMBODIMENT

Figure 1:
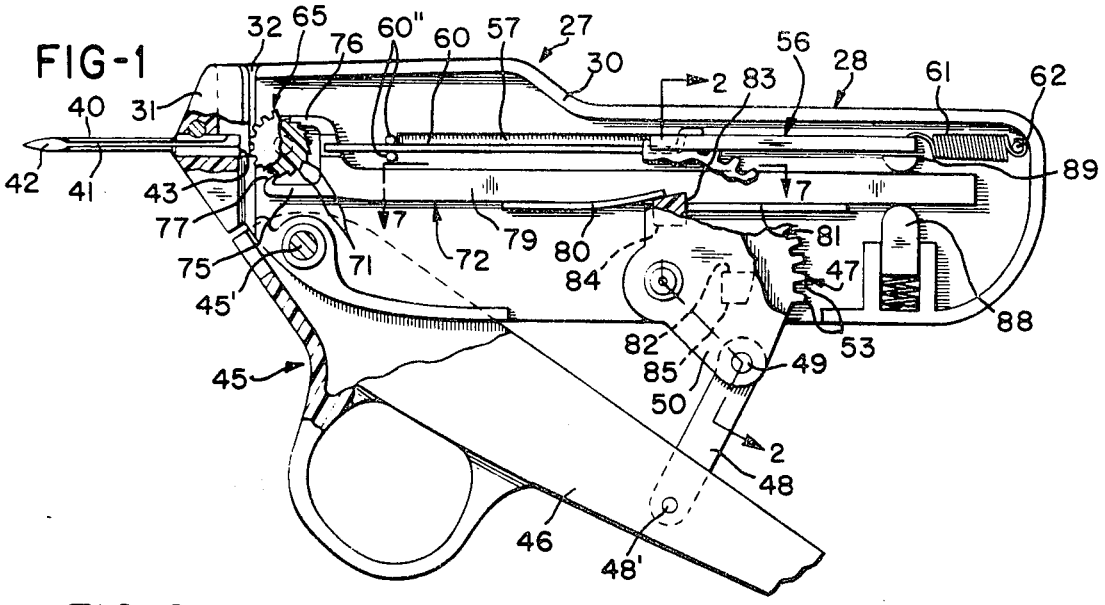
FIG. 1 is a side elevational view with certain parts broken away for clarity, showing operative components of a tag attaching apparatus in their initial positions.
Figure 2:
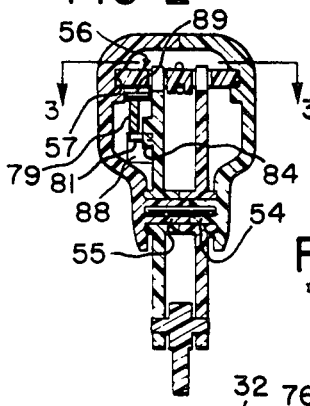
FIG. 2 is a sectional view taken along line 2—2 of FIG. 1.
Figure 3:
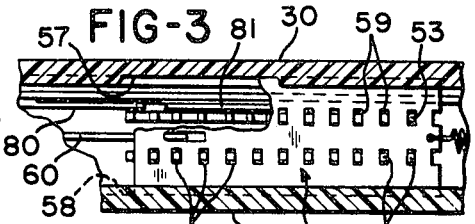
FIG. 3 is a fragmentary sectional view taken along line 3—3 of FIG. 2.
Figure 4:
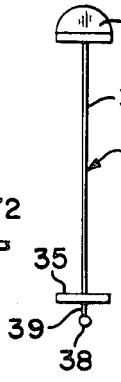
FIG. 4 is an end elevational view of a fastener assembly.
Figure 5:
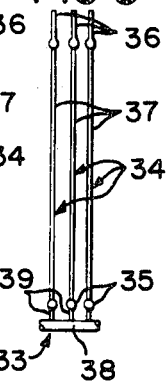
FIG. 5 is a fragmentary side elevational view of the fastener assembly shown in FIG. 4.
Figure 7:
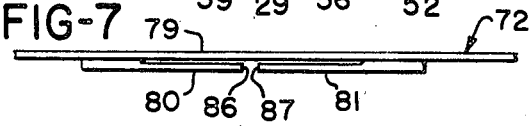
FIG. 7 is a sectional view taken along line 7—7 of FIG. 1.

Referring to the embodiment of FIGS. 1 through 9, there is disclosed a tag attaching apparatus generally indicated at 27. The apparatus 27 has a body 28 with two body sections 29 and 30. The body 28 has a nose portion 31 having a guideway 32 adapted to receive a fastener assembly 33 of the type shown in FIGS. 4 and 5. The fastener assembly 33 includes a plurality of fasteners 34. Each fastener 34 includes a bar section 35 and a head or button section 36 joined by a filament section 37. The fasteners 34 are connected to a common carrier member or runner 38 by respective coupling members or connectors 39. The guideway 32 is adapted to receive the common carrier member 28, the coupling members 39, and the bar section 35 and the filament sections 37 extend out of the side of the apparatus 27.

The nose portion 31 mounts a hollow needle 40 having an elongated slot 41. The bar section 35 is able to pass through the bore or passage 42 which extends through the needle 40 while its filament section 37 extends or projects through the slot 41. The needle 40 has a rear cutting edge 43 for cutting the bar sections 35 from their respective coupling members 39. The needle 40 has a slot 44 through which the bar sections 35 can descend into the needle 40. An actuator generally indicated at 45 is shown to comprise a hand lever 46 adapted to be engaged by the user's fingers. The hand lever 46 is pivotally mounted to the body 28 by a pin or shaft 45'. The lever 46 is drivingly connected to gear means generally indicated at 47 by a link or connecting member 48. The connecting member 48 is pivotally connected to the hand lever 46 by a pin 48' and to the gear means 47 by a pin 49. The gear means 47 is shown to comprise a pair of gear segments 50 and 51 having respective teeth 52 and 53. The gear segments 50 and 51 are in turn pivotally mounted to the body 28 by means of aligned posts 54 and 55 formed integrally with respective body sections 29 and 30. A slide generally indicated at 56 is guided for sliding movement in guideways or slots 57 and 58 in the respective body sections 30 and 29. The slide 56 has a plurality of sets of holes 59 to receive the teeth 52 and 53. Thus, the slide 56 includes a gear section or specifically a rack with which the gear segments 50 and 51 cooperate. An ejector or push rod 60 is securely held to the slide 56 so that the slide 56 and the push rod 60 move as a unit upon manual actuation of hand lever 46. The push rod 60 is guided by means of a guide member 60" so that the push rod 60 moves in alignment with the bore 42 of the needle 40. When the user squeezes the hand lever 46 while the body 28 is against the palm of the user's hand, the hand lever 46 pivots counterclockwise (FIG. 1) about pin 45' and thus the gear means 47 pivots counterclockwise and the slide 56 and the push rod 60 are driven to the left. As the push rod 60 moves to the left it drives the bar section 35 of the fastener 34 through the needle 40 and in so doing causes the bar section 35 to be severed from its respective coupling member 39. A return spring 61 is connected at one end to the slide 56 and at its other end to a post 62 secured to the body section 30. When the hand lever 46 is released from the squeezing action exerted by the user, the return spring 61 will cause the hand lever 46, the member 48, the gear means 47, the slide 56 and the push rod 60 to return to their respective initial positions shown in FIG. 1.

The apparatus 27 includes a fastener assembly feeding mechanism generally indicated at 65 for feeding the fastener assembly 33 to position one bar section 35 at a time into alignment with the bore 42 of the needle 40. The feeding mechanism 65 is shown to include a toothed member 66 specifically a wheel secured to a shaft 67 rotatably mounted in a hole 68 in the body section 30. The wheel 66 has a plurality of teeth 69 disposed on the periphery for engaging the coupling member 39. The mechanism 65 also includes a toothed member 70 specifically a ratchet wheel. The wheel 70 has a plurality of teeth 71 disposed on the periphery. The wheel 70 is rotated counterclockwise (FIGS. 1 and 6) by action of a cooperable member including a pawl generally indicated at 72. The pawl 72 is mounted for generally back and forth or reciprocable movement and is preferably of one-piece molded plastics construction. The pawl 72 includes a generally U-shaped portion 73 having a bight 74 and a pair of arms 75 and 76. The arm 75 has a tooth 77 at its free end portion which cooperates with the teeth 71 one-at-a-time. A guide or bearing member 78 (FIG. 8) having an annular outer peripheral bearing surface is in contact with the arm 76. The member 78 exerts a force on the arm 76 which is opposed to the force the wheel 70 exerts on the tooth 77. The pawl 72 is constructed of flexible resilient molded plastics material and thus both arms 75 and 76 flex as the tooth 77 moves over a tooth 71 and as the tooth 77 drives the wheel 70. If desired one of the arms 75 and 76 can be made heavy in section so that essentially all the flexure takes place in the other of the arms 75 and 76. It is apparent that the arms 75 and 76 straddle the axis of rotation of the toothed members 66 and 70, the member 78 and the shaft 67. The members 66, 70 and 78 and the shaft 67 are secured together and are preferably of one-piece molded plastics construction.

The pawl 72 is considered to have a body 79 to which the U-shaped portion 73 and flexible resilient arms 80 and 81 are integrally connected. Drive faces 82 and 83 are provided by projections 84 and 85 connected to the gear segment 51 of the gear means 47. The drive face 82 is cooperable with an abutment face 86 on the member 80 and the drive face 83 is cooperable with an abutment face 87 on the member 81. In the initial or home position shown in FIG. 1, the drive face 83 is in contact with the abutment face 87. When the user squeezes the lever 46, the projection 85 contacts the underside of the member 81 and deflects the member 81 and thereafter the drive face 82 contacts the abutment face 86 and moves the pawl 72 generally to the left as viewed in FIG. 1 to the position shown in FIG. 6. In so doing the leading end of push rod 60 pushes the bar section 35 of a fastener 34 to the left through the bore 42 of the needle while the filament section extends through the slot 41. In addition, the tooth 77 of the pawl 72 skips over a tooth 71 of the wheel 70 and the pawl 72 is now in a ready or cocked position. When the user releases the squeezing grip on the hand lever 46, the spring 61 returns the slide 56 from the position shown in FIG. 6 to the position shown in FIG. 1 and near the end of such travel of the slide 56, the gear 47 has moved to a position in which the projection 84 contacts and deflects the member 80 and the drive face 83 contacts the abutment face 87 to drive the pawl 72 to the position shown in FIG. 1. In so doing, the pawl 72 drives the wheel 70 and in turn the wheel 66 to advance the fastener assembly 33 to a position in which the bar section 35 of the next successive fastener 34 is brought into alignment with the needle bore 42 and the push rod 60.

It is to be noted that the pawl 72 is a one-piece plastics molded part in which the members or arms 75, 76, 80 and 81 are molded integrally with the pawl body 79. It is apparent that the pawl 72 is quite versatile for a one-piece member. Various features such as the U-shaped portion 73 are useful without requiring the specific actuating means including the pair of oppositely extending members 80 and 81, and vice versa.

Figure 6:
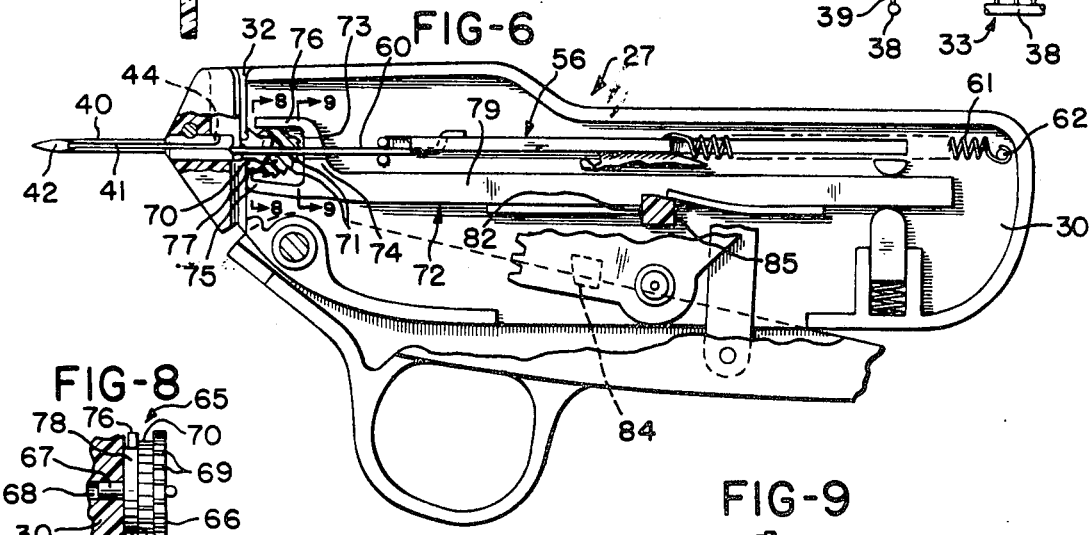
FIG. 6 is a view similar to FIG. 1, but showing the operative components in a different position than in FIG. 1.
Figure 8:
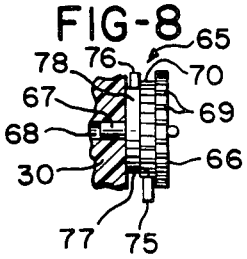
FIG. 8 is a sectional view taken generally along line 8—8 of FIG. 6.
Figure 9:
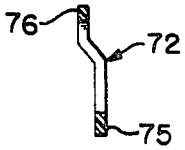
FIG. 9 is a sectional view taken generally along line 9—9 of FIG. 6.

A spring-urged plunger 88 acts on the pawl 72 to urge the pawl 72 against a stop 89 secured to the body section 30, so that the pawl 72 can rack as it moves between the positions shown in FIGS. 1 and 6.

A suitable detent (not shown) for example like the detent 91*a* shown in U.S. Pat. No. 3,759,435 is provided to prevent the toothed members 66 and 70 and the bearing member 78, which are integral, from rotating while the pawl 72 is driven from the position shown in FIG. 1 to the position shown in FIG. 6.

Other embodiments and modifications of this invention will suggest themselves to those skilled in the art, and all such of these as come within the spirit of this invention are included within its scope as best defined by the appended claims.

I claim:

1. Apparatus for attaching tags using an assembly of fasteners, each fastener including a bar section and a button section joined by a filament section, a runner and a connector individual to each fastener connecting the respective bar section to the runner, the apparatus comprising: a body, a needle mounted by the body, the needle having a bore and an elongated slot communicating with the bore, a push rod engageable with the bar section of a fastener for driving the bar section through the bore while its filament section extends through the slot, means for advancing one fastener at a time into alignment with the bore including a rotatably mounted toothed wheel, a pawl for driving the toothed wheel, and means for driving the push rod and the pawl, means providing an annular bearing surface disposed adjacent to and coaxial with the toothed wheel, the pawl including a first arm in contact with the means providing the bearing surface and a second arm having a tooth cooperable with the toothed wheel, at least one of the arms being flexible and resilient, the first arm exerting force on the means providing the bearing surface to cause the tooth to be in cooperable contact with the toothed wheel.

2. Apparatus as defined in claim 1, wherein the means providing the bearing surface includes an annular member secured to the toothed wheel.

3. Apparatus as defined in claim 1, the pawl being movable between first and second positions, the driving means including a manually operable actuator, first and second projections mounted for movement on the body and driven by the actuator, and first and second abutment members integrally connected to the pawl, the first projection being cooperable with the first abutment member to drive the pawl from the first position to the second position and the second projection being cooperable with the second abutment to cause the feed wheel to feed the fastener assembly.

4. Apparatus for attaching tags using an assembly of fasteners, each fastener including a bar section and a button section joined by a filament section, a runner and a connector individual to each fastener connecting the respective bar section to the runner, the apparatus comprising: a body, a needle mounted by the body, the needle having a bore and an elongated slot communicating with the bore, a push rod engageable with the bar section of a fastener for driving the bar section through the bore while its filament section extends through the slot, means for advancing one fastener at a time into alignment with the bore including a rotatably mounted toothed wheel, a pawl for driving the toothed wheel, and means for driving the push rod and the pawl, a generally annular member disposed adjacent the toothed wheel, the pawl including an arm having a tooth and further including means in contact with the generally annular member for causing the tooth to contact the toothed wheel.

5. Apparatus as defined in claim 4, wherein the generally annular member is secured to the toothed wheel.

6. Apparatus as defined in claim 4, the advancing means further including a second toothed wheel engageable with the connectors, wherein the toothed wheels are secured against rotation to each other.

7. Apparatus for attaching tags using fasteners, each fastener including a bar section and a button section joined by a filament section, the apparatus comprising: a body, a needle mounted by the body, the needle having an elongated slot communicating with the bore, a push rod engageable with the bar section of a fastener for driving the bar section through the bore while its filament section extends through the slot, means for advancing one fastener at a time into alignment with the bore including a toothed member, a movable pawl member cooperable with the toothed member, means for driving the push rod, the pawl member including a first flexible resilient arm having a tooth cooperable with the toothed member, guide means carried by the body for guiding the pawl member and a second flexible resilient arm connected to the pawl member and movable with the pawl member for extering a force on the guide means to urge the pawl tooth into contact with the toothed member, both the first and second arms being yieldable as the pawl tooth moves relative to the toothed member.

8. Apparatus as defined in claim 7, wherein the pawl member and the arms are integral.

9. Apparatus for attaching tags using an assembly of fasteners, each fastener including a bar section and a button section joined by a filament section, a runner and a connector individual to each fastener connecting the respective bar section to the runner, the apparatus comprising: a body, a needle mounted by the body, the needle having a bore and an elongated slot communicating with the bore, a push rod engageable with the bar section of a fastener for driving the bar section through the bore while its filament section extends through the slot, means for advancing one fastener at a time into alignment with the bore including a rotatably mounted toothed wheel, a pawl for driving the toothed wheel, and means for driving the push rod and the pawl, a generally annular member disposed adjacent the toothed wheel, the pawl having a generally U-shaped portion including a first arm having a tooth and a second arm in contact with the generally annular member for causing the tooth to contact the toothed wheel.

10. Apparatus as defined in claim 9, wherein both arms are flexible and resilient.

11. Apparatus for attaching tags using an assembly of fasteners, each fastener including a bar section and a button section joined by a filament section, a runner and a connector individual to each fastener connecting the respective bar sections to the runner, the apparatus comprising: a body, a needle mounted by the body, the needle having a bore and an elongated slot communicating with the bore, a push rod engageable with the bar section of a fastener for driving the bar section through the bore while its filament section extends through the slot, means for advancing one fastener at a time into alignment with the bore including a rotatably mounted toothed wheel having an axis of rotation, a pawl for driving the toothed member, and means for driving the push rod and the pawl, the pawl having a pair of arms straddling the axis of rotation of the toothed wheel, a guide disposed adjacent the toothed wheel, one of the arms having a tooth cooperable with the toothed wheel and another of the arms being in guided contact with the guide.

12. Apparatus for attaching tags using an assembly of fasteners, each fastener including a bar section and a button section joined by a filament section, a runner and a connector individual to each fastener connecting the respective bar section to the runner, the apparatus comprising: a body, a needle mounted by the body, the needle having a bore and an elongated slot communicating with the bore, a push rod engageable with the bar section of a fastener for driving the bar section through the bore while its filament section extends through the slot, means for advancing one fastener at a time into alignment with the bore including a rotatably mounted toothed wheel having an axis of rotation, a pawl for driving the toothed member, and means for driving the push rod and the pawl, the pawl having a generally U-shaped portion, the generally U-shaped portion including a pair of arms straddling the axis of rotation of the toothed wheel, a guide disposed adjacent the toothed wheel, one of the arms having a tooth cooperable with the toothed wheel and another of the arms being in guided contact with the guide.

13. Apparatus for attaching tags using an assembly of fasteners, each fastener including a bar section and a button section joined by a filament section, a runner and a connector individual to each fastener connecting the respective bar section to the runner, the apparatus comprising: a body, a needle mounted by the body, the needle having a bore and an elongated slot communicating with the bore, a push rod engageable with the bar section of a fastener for driving the bar section through the bore while its filament section extends through the slot, means for advancing one fastener at a time into alignment with the bore including a rotatably mounted toothed wheel, a pawl for driving the toothed wheel, and means for driving the push rod and the pawl, a guide mounted by the body, the pawl having a plurality of flexible resilient arms, one of the arms having a tooth cooperable with the toothed member and another of the arms being in contact with the guide.

14. Apparatus as defined in claim 13, wherein the pawl and the arms are integral.

15. Apparatus for attaching tags using an assembly of fasteners, each fastener including a bar section and a button section joined by a filament section, a runner and a connector individual to each fastener connecting the respective bar section to the runner, the apparatus comprising: a body, a needle mounted by the body, the needle having a bore and an elongated slot communicating with the bore, a push rod engageable with the bar section of a fastener for driving the bar section through the bore while its filament section extends through the slot, means for advancing one fastener at a time into alignment with the bore including a rotatably mounted toothed wheel, a pawl for driving the toothed wheel, and means for driving the push rod and the pawl, wherein the pawl includes a body and a pair of integrally formed resilient arms having respective abutment faces, and means providing a pair of drive faces alternately cooperable with the abutment faces for driving the pawl from a first position and for thereafter driving the pawl from the second position to the first position to cause the pawl to drive the toothed wheel to advance the fastener assembly, wherein the pawl further includes a pair of arms integrally connected to the pawl body, a guide mounted by the apparatus body, one of the arms being in guided contact with the guide, the other arm having a tooth cooperable with the toothed wheel.

16. Apparatus as defined in claim 15, wherein the driving means further includes gear means coupled to the drive faces, means including a manually engageable actuator mounted by the apparatus body for moving the gear means, and wherein the abutment members extend in generally opposite directions.

* * * * *